United States Patent [19]

Redeker et al.

[11] Patent Number: 4,496,340

[45] Date of Patent: Jan. 29, 1985

[54] SCREW CENTRIFUGE WITH A WASHING DEVICE

[75] Inventors: Detmar Redeker, Cologne; Dieter Mrotzek, Leverkusen, both of Fed. Rep. of Germany

[73] Assignee: Bayer Aktiengesellschaft, Leverkusen, Fed. Rep. of Germany

[21] Appl. No.: 486,465

[22] Filed: Apr. 19, 1983

[30] Foreign Application Priority Data

May 3, 1982 [DE] Fed. Rep. of Germany ..... 3216393

[51] Int. Cl.[3] ..... B04B 15/12

[52] U.S. Cl. ..... 494/29; 494/27; 494/53

[58] Field of Search ..... 210/772; 494/23, 24, 494/27, 29, 50, 52, 53

[56] References Cited

U.S. PATENT DOCUMENTS 3,348,767 10/1967 Ferney ..... 494/27

3,971,509 7/1976 Johnsen ..... 494/27

*Primary Examiner*—Robert W. Jenkins

*Assistant Examiner*—Arthur D. Dahlberg

*Attorney, Agent, or Firm*—Sprung, Horn, Kramer & Woods

[57] ABSTRACT

The screw centrifuge has a cylindrical clarifying part and a conical desiccating part which is provided with axial supply pipes for a washing liquid and with openings for the passage of the washing liquid into the chamber between the drum and the screw core. A substantial improvement in the washing effect is achieved in that the openings are connected to a liquid distributor which is positioned along a cylindrical helix and which charges the washing liquid regularly along the screw flank over at least one turn in the vicinity of the screw core. The liquid distributor either comprises an overflow channel which is positioned in or directly upstream of the screw flank, or it is formed from a compact series of nozzles which are directed at the screw flank. It is an essential feature of this arrangement that the solids which are pushed up by the screw flanks are covered and saturated regularly with the washing liquid.

11 Claims, 9 Drawing Figures

SCREW CENTRIFUGE WITH A WASHING DEVICE

BACKGROUND OF THE INVENTION

This invention relates to a screw centrifuge which comprises a preferably cylindrical clarifying part and a conical desiccating part and is provided with axial supply pipes for a washing liquid and with openings for the passage of the washing liquid into the chamber between the screw drum and the screw core.

Solid bowl screw centrifuges (decanters) are mainly used for separating operations in continuous processes. However, they have also proved to be efficient in a charge operation, because only a relatively small surface is required for installation, no outgoing air is produced during desiccation and the installation and maintenance costs are relatively low.

A problem which often occurs is that the solids have to be washed after separation from the liquid. Decanters have been developed for this purpose, in which washing devices are installed (DE-OS 2,165,508). In this arrangement, the washing device substantially comprises axial supply pipes and openings in the screw core for the passage of the washing liquid into the clarifying chamber. The washing liquid discharges through the openings over the solids.

Furthermore, a decanter with a washing device is known, in which small pipes are radially inserted into the screw body in the conical part, through which the washing liquid is sprayed onto the solids.

According to experience, only relatively poor washing results are obtained using such washing devices in decanters, compared to the results of a pure throughflow experiment. The present invention becomes applicable at this point. An object thereof is to improve the efficiency of washing devices in a decanter by constructive measures.

SUMMARY OF THE INVENTION

This object is achieved according to the present invention in that the openings for the passage of the washing liquid are connected to a liquid distributor which is positioned around the rotor axis along a cylindrical helix, which distributor discharges the washing liquid regularly along the screw flank over at least one turn (360° C.) in the vicinity of the screw core.

According to a preferred embodiment, the liquid distributor comprises an overflow channel having a weir which is positioned either on or immediately upstream of the screw flank. The overflow channel and/or the weir are advantageously sub-divided into several segments and may be adjusted in a radial direction. A particularly regular distribution of the liquid is achieved if the weir is designed to be jagged.

Furthermore, the distribution of the washing liquid is favorably influenced if axially-parallel driving ridges are positioned in the overflow channel.

In an alternative embodiment, the liquid distributor comprises a compact series of nozzles or spray pipes which are directed at the screw flank.

In both embodiments, the supply pipes which lead from the screw core to the overflow channel or to the nozzles are oriented in the screw core on the same internal diameter. In this manner, washing liquid is provided regularly to all the supply pipes.

The following advantages are obtained with the present invention:

1. Unlike the prior art decanters, the washing device is designed such that the complete slope of solids which are pushed up in the shape of a triangle is covered with the washing liquid. By a suitable metering of the washing liquid, as much washing liquid may be readily added at any point of the screw spirals as may filter through the solids incline which lies upstream of the screw flank. Consequently, the short washing zone which is available is used optimally. In contrast thereto, in the case of the prior are decanters,the washing liquid is discharged in a punctiform manner on the solids.

2. The expense in constructing apparatus according to the present invention is relatively small. In particular, the liquid distributor in the form of an overflow channel may be subsequently installed without difficulty in decanters which are already available.

3. As a result of closing individual in-flows, the length and the position of the washing zone in the decanter may be adjusted and adapted to product-specific requirements.

Embodiments of the present invention will now be described in more detail with reference to the accompanying drawings, in which:

DETAILED DESCRIPTION OF THE INVENTION

Figure 1:
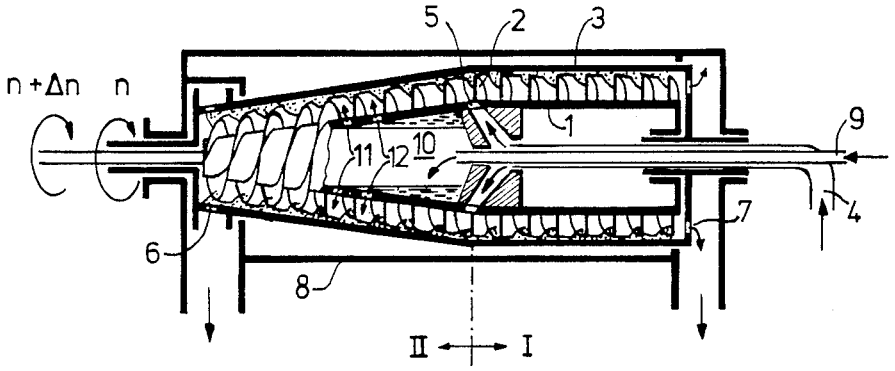
FIG. 1 illustrates a general view of a solid bowl screw centrifuge.

The solid bowl centrifuge according to FIG. 1 comprises a screw 2 attached to a core 1 and a drum casing 3 (drum) surrounding the screw 2. The drum 3 and the screw 2 are mounted rotatably and are driven at different speeds so that a transporting effect is produced towards the cone. In the clarifying part I, the drum and the screw are cylindrical and in the desiccating part II, they are conical. The suspension to be clarified is delivered through the supply pipe 4 and it passes into the centrifuge drum 3 through bores 5 in the screw core 1. As a result of the centrifugal force, the comparatively heavy solids are centrifuged outwards and conveyed to the solids outlet 6 by the screw 2. The comparatively light liquid flows away to the other end through the overflows 7. The solids and the liquid are collected by the housing 8 and discharged.

The desiccating part II also has installed a washing device which comprises an axial supply pipe 9 and a chamber 10 for the washing liquid and openings 11 and 12 in the screw core. The washing apparatus operates in that washing liquid flows through the openings 11 and 12 onto the solids which are transported by the screw and the mixture is again centrifuged in the subsequent sections of the screw. In this respect, the solid bowl screw centrifuge which has been described corresponds to the prior art.

The new washing apparatus will now be described with reference to the following Figures.

Figure 2:
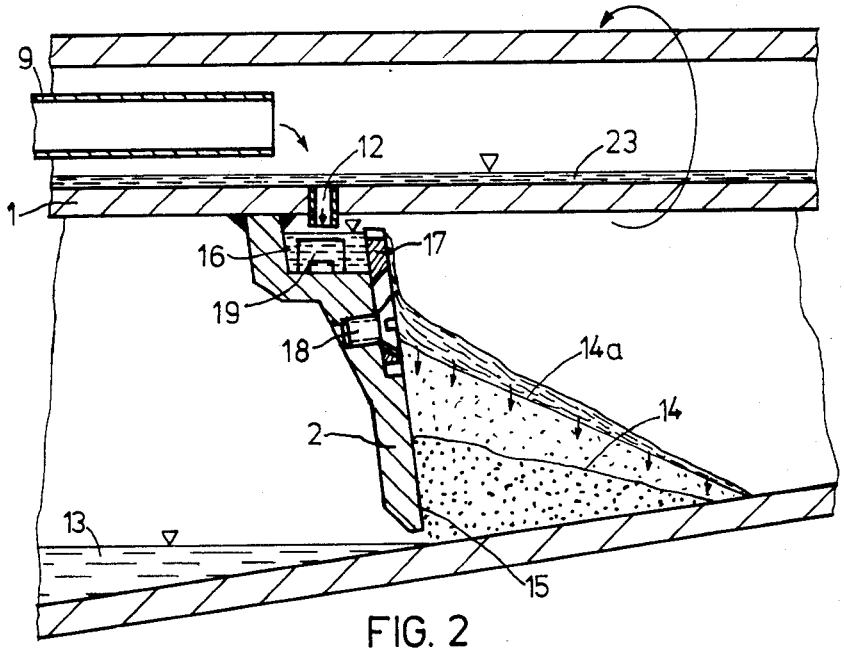
FIGS. 2 and 4 illustrate washing devices in a decanter in the form of overflow channels along the screw flanks.

FIG. 2 illustrates an enlarged section in the region of the conical desiccating part II. The solids 14 which have settled in the sump 13 are conveyed up the cone by the screw 2. During this motion, the solids are pushed up into a triangular profile.

A specific liquid distributor ensures that the liquid is not directly sprayed onto the solids slope 14*a*, but is discharged at the highest point of the solids slope 14*a* along the screw flank 15 or along the weir 17. For this purpose, the screw 2 is designed to include an overflow channel 16 in the vicinity of the core 1, i.e., in the upper third of the screw flank. The overflow is formed by the weir 17 which is positioned so that it may be oriented radially on the screw flank 15 by means of a bolt 18 and an oblong hole attachment. The upper edge of the weir 17, i.e., the overflow edge, is of a jagged design. Axially-parallel driving ridges 19 are inserted into the channel 16.

Figure 3:
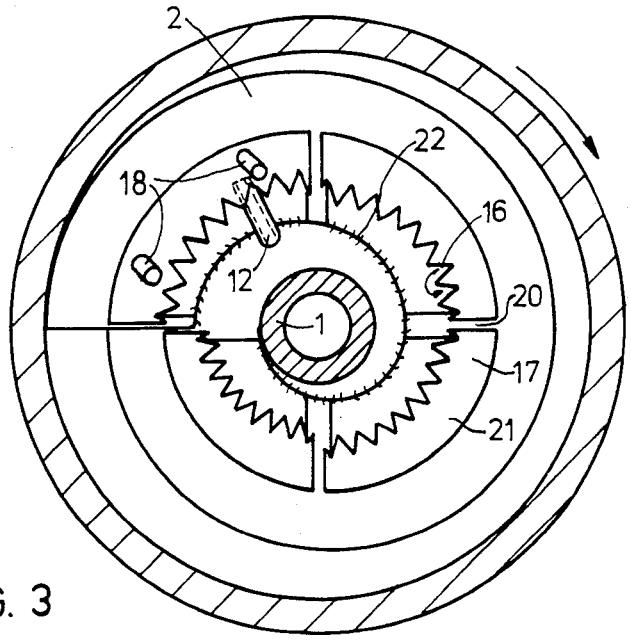
FIG. 3 illustrates a cross section through the washing device according to FIG. 2.

According to FIG. 3, which illustrates a section transversely to the axis of the drum having a screw turn in the desiccating part, the channel 16 is subdivided by radial ridges 20 along the screw 2 and is restricted by weir segments 21. The sub-division facilitates the assembly and adjustment of the channel 16 or of the weir 17. The radius of the jagged weir 17 is constant over each segment. The center line is the drum axis.

This Figure also shows the oblong hole attachment for the overflow weir 17 which has already been described above. The weir 17 may be unscrewed to clean the channel 16. Each segment of the channel is supplied with washing liquid through a separate supply opening 12. Reference numeral 22 designates the weld of the screw 2 on the core 1 which is conical in this case.

The washing liquid flows through the supply pipe 9 (FIG. 2) into the hollow screw core and forms therein a cylindrical liquid ring 23 during steady state operation of the centrifuge. The washing liquid from the ring 23 passes through the openings 12 in the screw core 1 which are designed as small short pipes into the overflow channel 16. The drivers 19 ensure a regular distribution of the washing liquid over the circumference of the channel 16. The liquid accumulates in the channel up to the jagged edge of the overflow weir 17 and flows from there in a regular layer over the weir and/or the screw flank onto the highest point of the solids slope 14*a*. In this way, it is ensured that the complete solids slope is covered and saturated with washing liquid, whereas in the case of a punctiform charge (spray application), only a fraction of the solids slope 14*a* is covered with the washing liquid. It is clear that, in such a case, only unsatisfactory washing results are obtained, because the wash only covers a part of the solids cross section. Particularly favorable conditions are produced if just enough washing liquid is metered in through the supply pipe 9 such that as much washing liquid is delivered at each point of the channel 16 as may filter away through the solids, in front of the screw flank, with a complete covering, and the thickness of the liquid layer is precisely zero at the lower end of the solids slope. If the quantity of washing liquid is increased above this value, then the excess liquid flows away ineffectively into the sump at the foot of the slope. This operating condition may be easily determined empirically (see FIG. 7).

Figure 4:
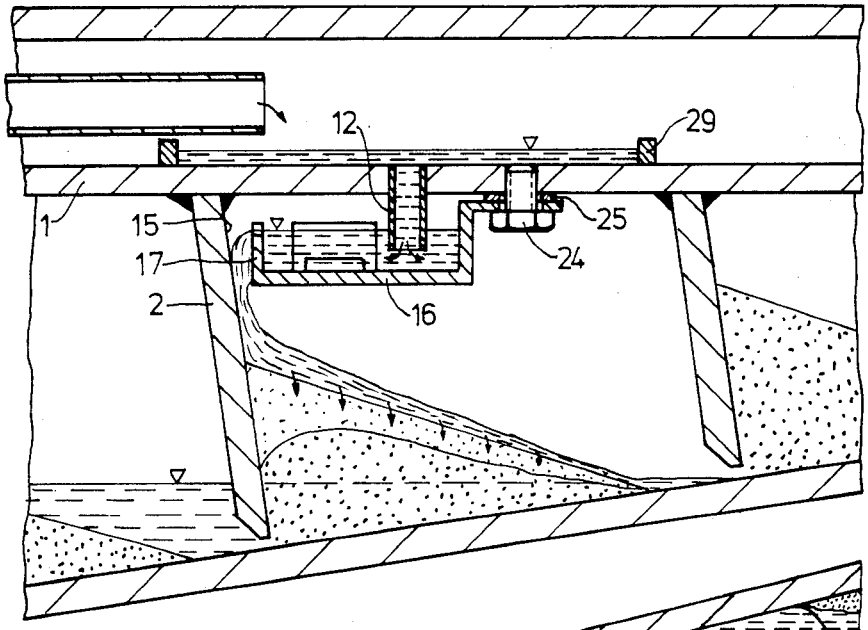

FIG. 4 illustrates another embodiment of the liquid distributor based on an overflow channel which is positioned helically around the rotor axis. In this Figure, the overflow channel 16 is not a component of the screw 2, as it was in the embodiment according to FIG. 2, but is positioned directly upstream of the screw flank 15. As in the case of the previously described embodiment, the overflow channel 16 has to be sub-divided into several segments per turn. These segments are secured to the screw core by means of bolts 24. The adjustment in a radial direction may be effected by means of, for example shims 25. The weir 17 on the channel 16 is located sufficiently close to the front of the screw flank 15 that the overflowing liquid is reliably delivered onto the highest point of the underlying solids. It is also possible with this embodiment to achieve a regular charge of the washing liquid along the screw flank 15, which is to be considered as a prerequisite for improving the washing effect. The radial spacing between the overflow channel 16 and the screw core 1 is relatively uncritical in both embodiments. However, for mechanical reasons and for an improved use of the free conveying cross section, the overflow channel 16 will be positioned as near to the screw core as possible, but at least in the upper third of the screw flank 15.

Figure 5:
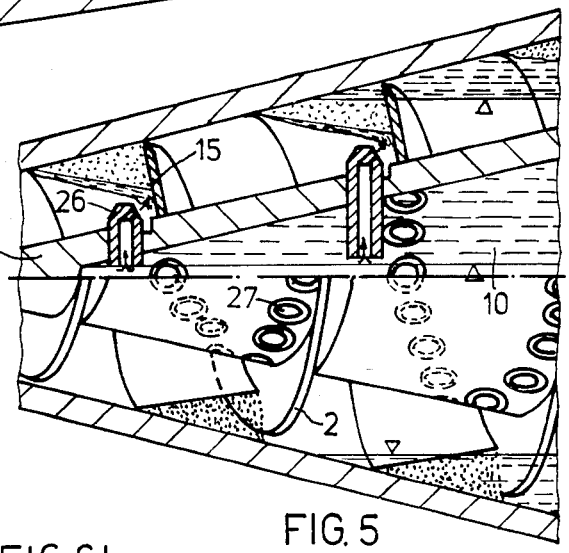
FIG. 5 illustrates a washing device in the decanter in the form of a row of nozzles, FIGS. *6a–6c* illustrate the shape of wide-jet small pipes instead of the nozzles.
Figure 6A:
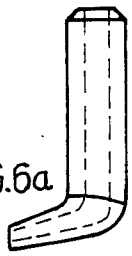
Figure 6B:
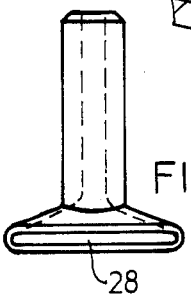
Figure 6C:
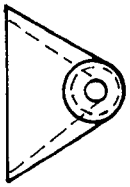

FIG. 5 illustrates another variant of the liquid distributor for charging the washing liquid onto the screw flank. According to this Figure (half section), the liquid distributor comprises a compact series of nozzles, preferably fan jet nozzles 26 which are positioned along a helix following the screw 2, directly upstream of the screw flank 15 and are aligned such that the issuing liquid is generally sprayed onto the joining point (weld 22) between the screw 2 and the screw core 1. For reasons of clarity, only the openings 27 for the nozzles 26 are indicated in the lower half of FIG. 5. These openings correspond to the openings 12 in the screw core in the embodiments according to FIGS. 2 to 4. The nozzles 26 are aligned on the same diameter inside the screw core 1. This also applies to the supplies to the channel segments in the embodiments according to FIGS. 2 to 4. This measure ensures that approximately indentical pressure conditions prevail in all the supplies. The nozzles 26 may also be designed as wide-jet pipes 28, as illustrated in FIG. 6*a* which is a slide elevation, FIG. 6*b* which is a front view and FIG. 6*c* which is a top view, so that a comparatively large angle may be covered on the screw flank 15.

The position and also the length of the washing zone in the desiccating part may be adjusted by initially providing a comparatively large region with openings 27 and then restricting the desired position and length of the washing zone by closing the pipes. In the embodiments according to FIGS. 2 to 4, the washing zone is restricted by the installation or removal of channel segments 21 or by opening or closing openings 12.

Another possibility of adjustment comprises, in a known manner, sub-dividing the screw core 1 into several chambers by ridges 29, and the washing zone is adjusted by displacing the washing pipe 9 or by charging each chamber through its own pipe.

Figure 7:
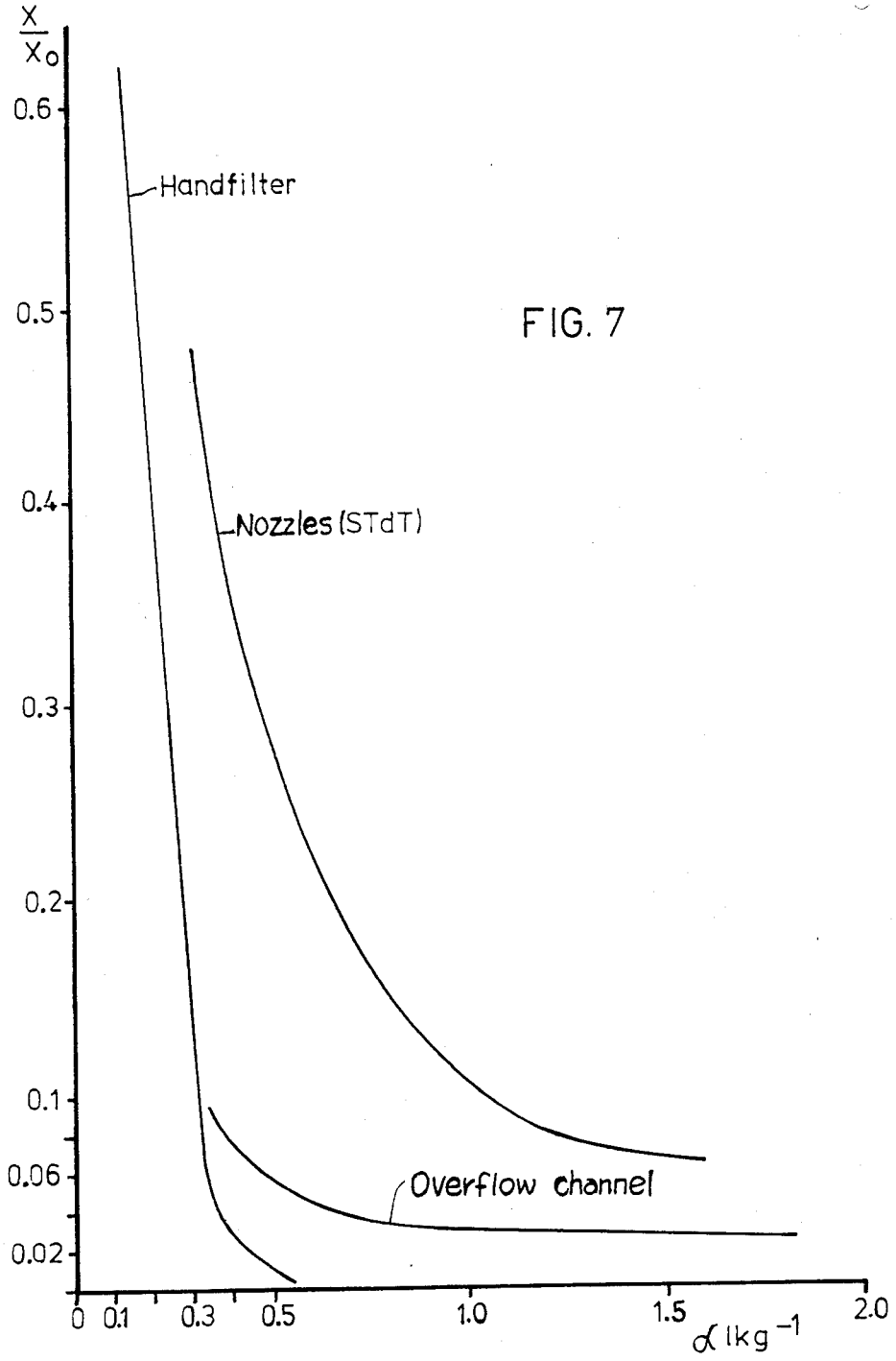
FIG. 7 is a diagram representing measured washing results.

To test the efficiency of the new washing apparatus, a suspension of saturated NaCl solution and gypsum was settled out in a solid bowl centrifuge and then washed with water. A liquid distributor based on an overflow channel according to FIGS. 2 to 4 was installed in the centrifuge as the washing device. For comparison, a washing apparatus according to the prior art (punctiform charge of the washing liquid at individual points) was also tested, and the washing results were established from a throughflow wash in a hand filter plate. The results are represented in FIG. 7. The ratio of the concentration of the NaCl solution in the discharged wet solids (X), based on the starting concentration ($X_o$) in % is plotted as the ordinate. The abscissa corresponds to the washing ratio Δ, and Δ represents the quantity of washing liquid in liters which is required for one kg of dry solids. Although somewhat simplified, it is clearly possible to say that the washing effects in FIG. 7 are compared to each other as a function of the quantity of washing liquid which has passed through in the different washing devices. High $X/X_o$ values signify a small washing effect and low $X/X_o$ values signify a good washing effect. Qualitatively, it may be seen that the hand filter experiment exhibits the best washing effect. Surprisingly, the washing experiments in a solid bowl centrifuge having an installed liquid distributor (overflow channel) come close to the experiment with the pure throughflow wash, whereas the punctiform charge of the washing liquid according to the prior art produces substantially poorer results. In the case of a washing ratio of, for example $\Delta=0.4\ 1\ kg^{-1}$, the following values are obtained for the residual content of common salt in the wet solids:

Throughflow experiment: x/xo=2.8 %

Overflow channel: x/xo=7.6 %

Nozzles (prior art) x/xo=32.6 %.

The new washing device is not only suitable for installation in solid bowl screw centrifuges, but may also be used successfully in screen type centrifugal machines, in which the solids are similarly pushed up in a triangular shape during transport. In the latter type of centrifuge, the drum is provided with a plurality of openings. Such centrifuges are described in detail in the literature (for example Hans-Heinrich Hulsen, Verfahrenstechnik 6 (1972) No. 1, pages 7 to 15).

I claim:

1. In a screw centrifuge having a drum and a screw core forming a cylindrical clarifying part and a conical desiccating part, an axial supply pipe into the screw core for a washing liquid and openings in the screw core for the passage of the washing liquid into a chamber between the drum and the screw core, the improvement comprising: liquid distributing means in communication with the openings and positioned around the screw core axis along a cylindrical helix for regularly distributing the washing liquid along the screw flank over at least one turn in the vicinity of the screw core, wherein the liquid distributing means comprises an overflow channel having a weir and wherein the overflow channel is positioned in the screw flank.

2. The screw centrifuge according to claim 1, wherein at least one of the overflow channel and the weir is sub-divided into segments

3. The screw centrifuge according to claim 1, wherein the weir has a jagged configuration.

4. The screw centrifuge according to claim 1, wherein the liquid distributing means further comprises axially-parallel driving ridges inserted into the overflow channel.

5. In a screw centrifuge having a drum and a screw core forming a cylindrical clarifying part and a conical desiccating part, an axial supply pipe into the screw core for a washing liquid and openings in the screw core for the passage of the washing liquid into a chamber between the drum and the screw core, the improvement comprising: liquid distributing means in communication with the openings and positioned around the screw core axis along a cylindrical helix for regularly distributing the washing liquid along the screw flank over at least one turn in the vicinity of the screw core, wherein the liquid distributing means comprises a compact series of nozzles positioned along a helix and directly upstream of the screw flank and which are directed at the screw flank to spray onto the joining line of the screw flank and screw core.

6. The screw centrifuge according to claim 5, wherein the liquid distributing means comprises an overflow channel and the openings to the overflow channel in the screw core are aligned on the same internal diameter.

7. The screw centrifuge according to claim 5, wherein the compact series of nozzles comprise wide-jet pipes

8. In a screw centrifuge having a drum and a screw core forming a cylindrical clarifying part and a conical desiccating part, an axial supply pipe into the screw core for a washing liquid and openings in the screw core for the passage of the washing liquid into a chamber between the drum and the screw core, the improvement comprising: liquid distributing means in communication with the openings and positioned around the screw core axis along a cylindrical helix for regularly distributing the washing liquid along the screw flank over at least one turn in the vicinity of the screw core, wherein the liquid distributing means comprises an overflow channel having a weir and wherein the overflow channel is positioned directly upstream of the screw flank.

9. The screw centrifuge according to claim 8, wherein at least one of the overflow channel and the weir is sub-divided into segments.

10. The screw centrifuge according to claim 8, wherein the weir has a jagged configuration.

11. The screw centrifuge according to claim 8, wherein the liquid distributing means further comprises axially parallel driving ridges inserted into the overflow channel.

* * * * *